United States Patent [19]

Zachry et al.

[11] 4,128,288

[45] Dec. 5, 1978

[54] ZERO INSERTION/RETRACTION FORCE CONNECTOR

[75] Inventors: Clyde Zachry; Paul K. White, both of Poway; Wilbur T. Layton, San Diego, all of Calif.

[73] Assignee: Burroughs Corporation, Detroit, Mich.

[21] Appl. No.: 801,155

[22] Filed: May 27, 1977

[51] Int. Cl.[2] ..... H01R 13/62

[52] U.S. Cl. ..... 339/45 M; 339/74 R; 339/75 MP

[58] Field of Search ..... 339/74 R, 75 M, 75 MP, 339/45 R, 45 M

[56] References Cited

U.S. PATENT DOCUMENTS 3,130,351 4/1964 Giel ..... 339/74 R

*Primary Examiner*—Neil Abrams

*Attorney, Agent, or Firm*—Joseph R. Dwyer; Mervyn L. Young; Kevin R. Peterson

[57] ABSTRACT

An entirely zero insertion/retraction force connector having a mechanism for receiving the conductor terminals of a device inserted therein. The connector includes means having conductor terminals which are separable by an actuating mechanism which responds to insertion of said device into the connector for receiving said device terminals without engagement between the connector terminals until the inserted device is fully positioned in the connector at which time resilient means urges the connector terminals toward one another thus electrically connecting (clamping) the device terminals therebetween. The force necessary to insert and move the inserted device to final position has no relationship to terminal contact pressure which is a function only of the force of the resilient means and in one embodiment of the invention there is no wiping force involved. In another embodiment, the camming means may be arranged to permit a slight wiping action of the terminals, if desired, without any major structural change to the connector.

8 Claims, 7 Drawing Figures

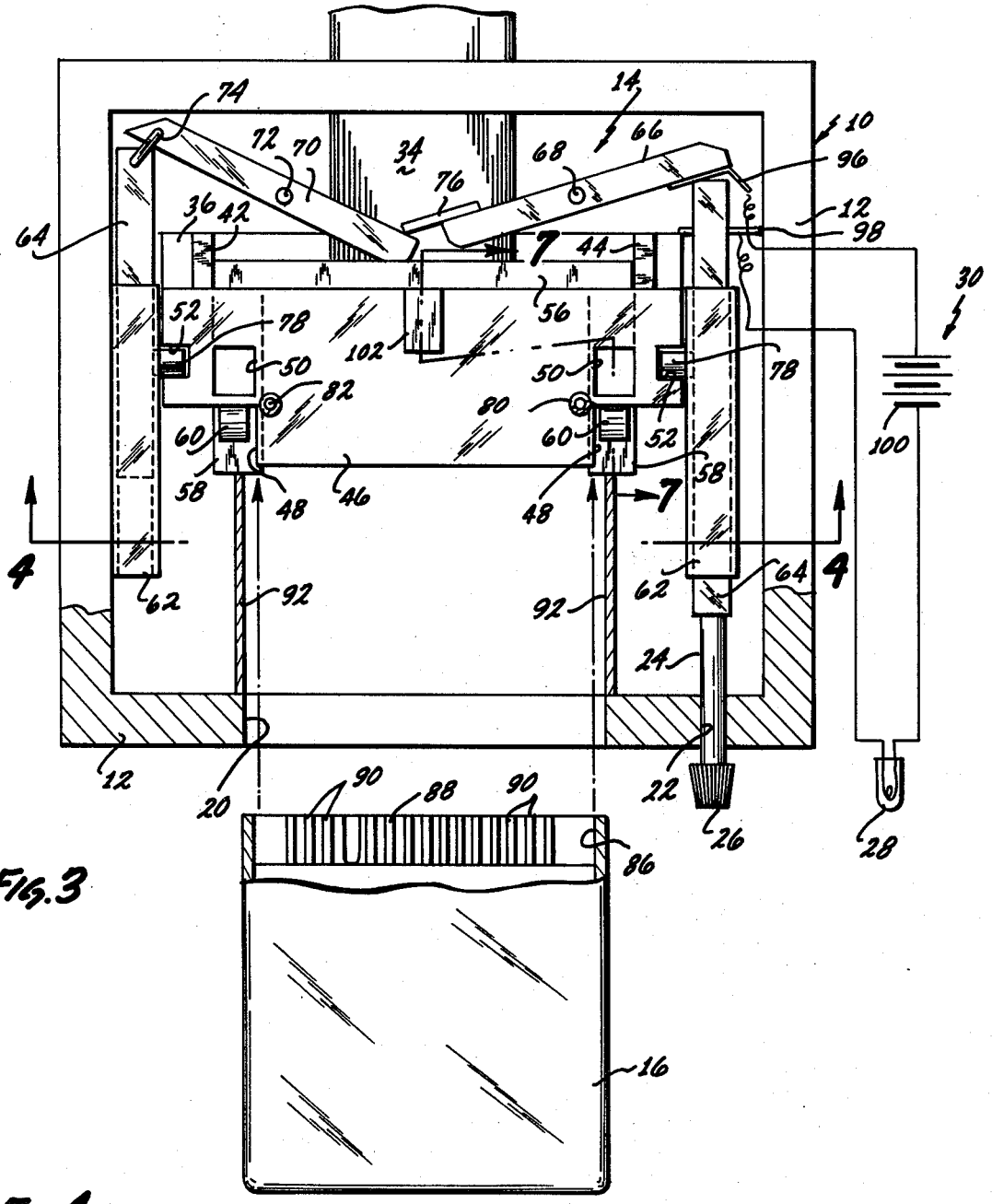
FIG. 3
FIG. 4
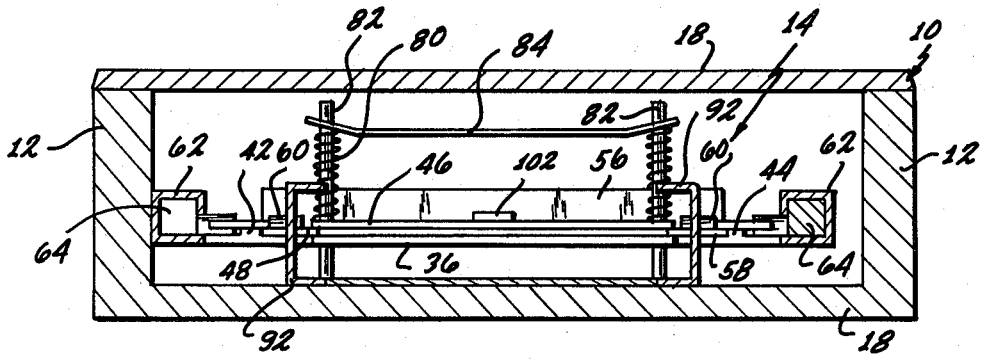

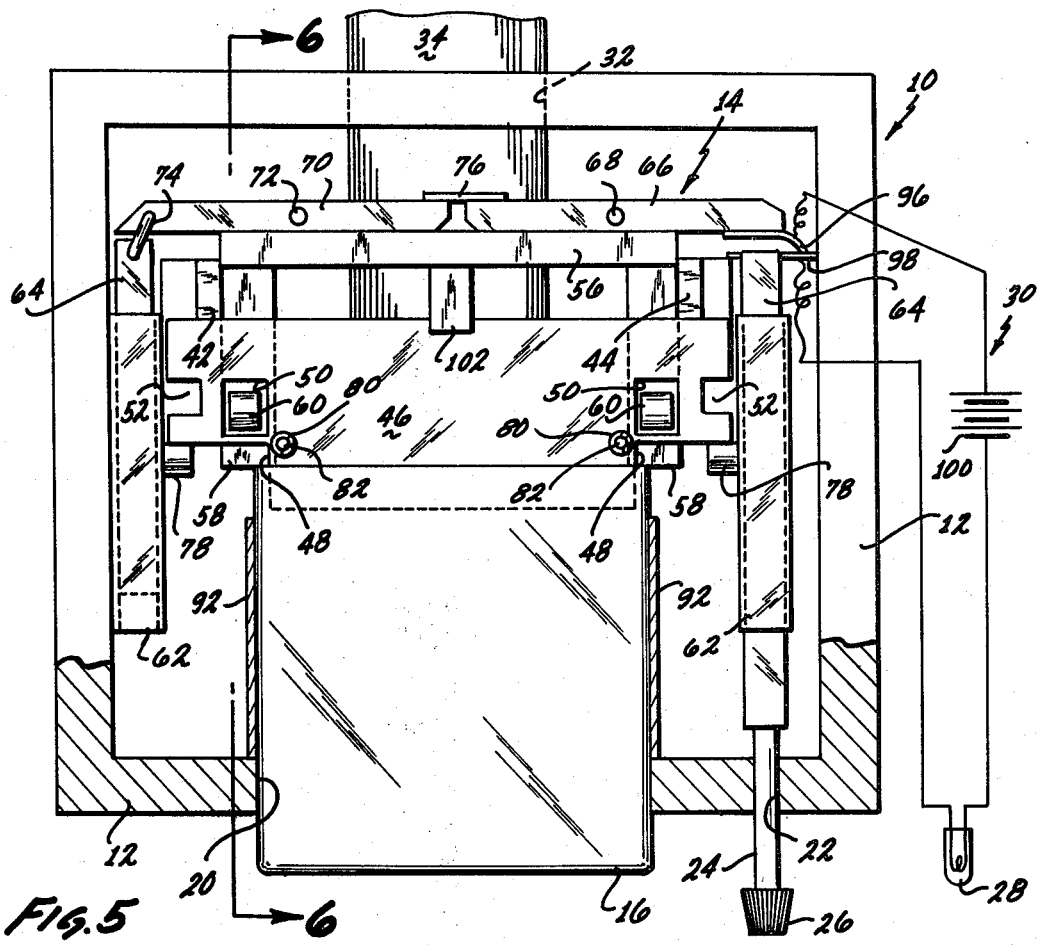
FIG. 5
FIG. 6
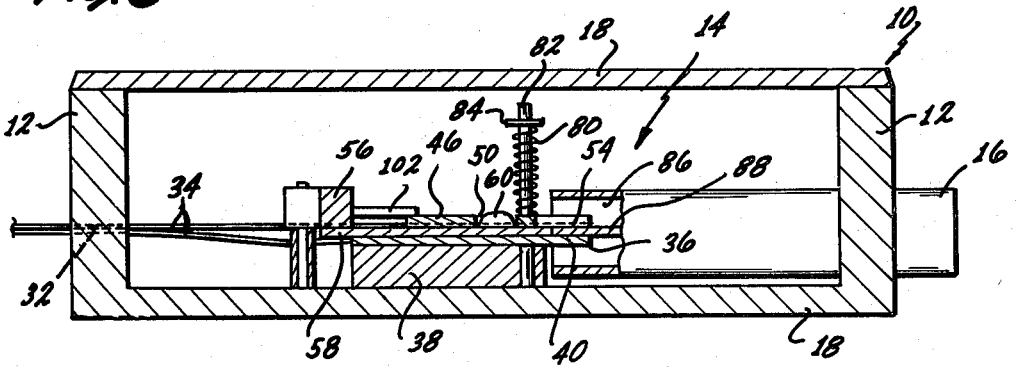

ZERO INSERTION/RETRACTION FORCE CONNECTOR

BACKGROUND OF THE INVENTION

1. Field of the Invention

This invention relates to electrical connectors for effecting electrical connections between electronic devices.

2. Prior Art

Zero initial insertion and zero retraction force connectors are well-known in the art, examples of which are shown in U.S. Patents to Harold Rosen U.S. Pat. Nos. 3,923,361 and 3,980,376 in which a printed circuit board having terminals or conductor areas are inserted in a connector for electrical connection to other electronic devices. These patents as well as the other patents in the prior art such as the U.S. Patent to Sprenkle, et al U.S. Pat. No. 3,944,311 and the U.S. Pat. No. 3,763,462 to Ecker while called zero insertion force connectors, actually should be more correctly called controlled wiping action connectors since they rely to a large degree on the thickness of the printed circuit board to finally separate resiliently positioned conductor terminals on the connector as the printed circuit board is being inserted and to provide a good electrical connection between the terminals of circuit card and the connector. Such wiping action, however limited or controlled, was thought necessary for a good electrical connection and these patents were premised on the assumption that the insertion force should be minimized but not eliminated. Thus, the device of these patents were directed to the control of the wiping force so as not to destroy the material of the conductors by excessive sliding force between the conductors of the inserted device and the connector.

On the other hand, it has been found that a truly zero insertion/zero retraction force connector is practical and beneficial. No wiping force is involved and the insertion force imposed by the connector on the terminals of the inserted device as will be apparent from the more detailed description of the invention herein after. Such a connector has no conductor contact wear, no abrasion problems and thus better reliability.

Accordingly, it can be stated that the object of this invention is to provide an entirely zero insertion/retraction connector for electrically connecting the terminals of an electronic device as with a connector for connecting to other electronic devices.

More specifically, it is a primary object of this invention to provide an entirely zero insertion/retraction force connector without any wiping action to thus prevent damage to the conductor components normally involved in printed circuit card installation techniques.

A secondary object of this invention is to provide an insertion/retraction force connector with a slight wiping action if desired without a major structural modification of the entirely zero insertion/retraction force connector.

SUMMARY OF THE INVENTION

An entirely zero insertion/retraction force connector having a mechanism for receiving the conductor terminals of a device inserted therein. The connector includes means having conductor terminals which are separable by an actuating mechanism which responds to insertion of said device into the connector for receiving said device terminals without engagement between the connector terminals until the inserted device is fully positioned in the connector at which time resilient means urges the connector terminals toward one another thus electrically connecting (clamping) the device terminals therebetween.

More specifically, the insertion of the device causes camming means to separate the connector terminals against the action of a resilient means and to remain separated until the device terminals are in final position at which time the camming means will enable the resilient means to urge the connector terminals toward one another. The force necessary to insert and move the inserted device to final position has no relationship to terminal contact pressure which is a function only of the force of the resilient means nor in one embodiment is there any wiping force involved.

While one embodiment of this invention relys entirely on the resilient means to provide electrical contact, the camming means may be arranged to permit a slight wiping action of the terminals, if desired.

BRIEF DESCRIPTION OF THE DRAWINGS

FIG. 3 is a top plan view partically broken away to illustrate the details of the actuating mechanism in a position before the insertable device is actually inserted in the connector;

FIG. 4 is a cross-sectional view taken along line 4—4 of FIG. 3.

FIG. 5 is a view similar to FIG. 3 but showing the insertable device in position in the connector;

FIG. 6 is a cross-sectional view of the connector taken along line 6—6 of FIG. 5.

DESCRIPTION OF THE PREFERRED EMBODIMENT

Figure 1:
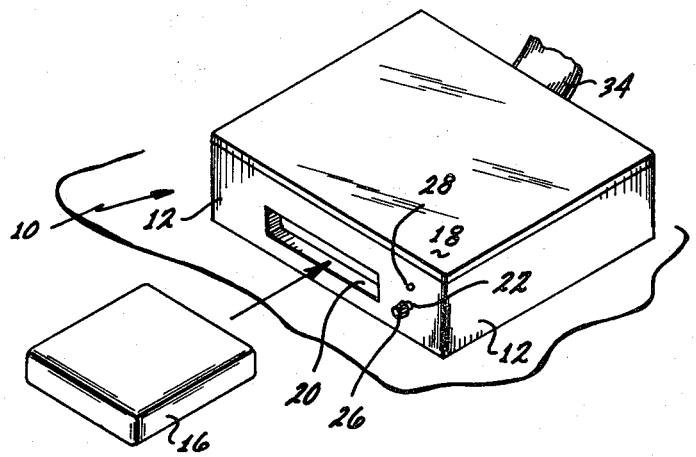
FIG. 1 is a perspective view of the zero insertion/retraction force connector and an insertable device to be connected.

Referring now to the drawings, the connector of the present invention as shown is a relatively thin rectangular box member 10 the walls 12 of which are high enough to incorporate the actuating mechanism 14 of the connector and to receive a portion of a device 16 within the top and bottom walls 18 thereof and further includes an elongated opening 20 in the front side wall for the reception of the device 16 which, for example, is a bubble memory cassette. The front wall further includes an aperture 22 through which a plunger 24 having a knurled knob 26 extends for reciprocal movement relative to the box and an opening for a lamp 28 indicating to the user that the connector is in either its open contact or closed contact position. (The lamp 28 and its circuitry 30 are shown outside the box in FIGS. 3 and 4 for sake of clariety). The back side wall is formed with an opening 32 to receive a ribbon type cable 34 or any suitable conductor for electrical contact between the connector and other electronic circuitry in a conventional manner.

The connector actuating mechanism 14 includes a bottom plate or terminal supporting member 36 of rectangular configuration of a length extending substantially the width of the box but covers only a portion of the distance between the back and front wall of the box and spaced from the bottom walls 18 by a spacer 38. The bottom plate 36 is provided with a plurality of resilient conductive leads forming electrical terminal contact terminals 40. These spring terminals are individually connected to selected individual connectors in the ribbon cable. On the left end of the plate there is provided a rail 42 extending the width of the plate and parallel to the side walls of the box. Likewise, the right end of the plate but spaced slightly therefrom is a similar rail 44 which also extends the width of the plate and parallel to the first rail to form a track.

A top plate or terminal supporting member 46 of the same width but slightly longer than the bottom plate is provided and is generally in a T-shaped configuration formed by a pair of corner notches 48 extending inwardly from the front edge. This top plate 46 is provided with a pair of rectangular apertures 50 which are spaced apart from each other the same distance as the distance between the two rails of the track so that the two apertures 50 will coincide with the rails 42 and 44 and is further provided with a pair of rectangular notches 52 on the ends of the plate, which are opened outwardly and are juxtaposed each of the first pair of apertures 50; the functions of which are later to be described. This top plate 46, like the bottom plate 36, is also provided with a plurality of resilient conductor leads or terminals 40 and are likewise connected to the conductors of the ribbon cable. Which of the conductors of the cable are connected to which terminal of the top and bottom plates or whether all the terminals are on the bottom or the top plate, is entirely at the discretion of the user.

Disposed between the two plates 36 and 46 is a fork member comprising a bar 56 and a pair of tynes 58; one located at each end of the bar and extending toward the front wall of the box. In the embodiment shown, the bar is substantially the width of the spacing between the two rails 42 and 44 of the track and corresponds to the distance between the two rectangular apertures 50 in the top plate so that the tynes will ride on the rails. Each tyne contains an upwardly extending cam 60 located substantially two-thirds of the distance between the bar and the end of the tyne which will be received in the rectangular apertures 50, as shown in FIG. 3, at the appropriate time when the bar moves relative to the box, i.e., transverse the width of the two plates.

Located on each end of the two plates are hollow channel members 62, shown rectangular in cross-section, in which a pair of plungers 64 reciprocate. The right-handed plunger 64 is connected to the previously mentioned plunger 24 (or may form a part thereof) extending through the front wall, and extends substantially the width of the box, and also engages one end of a lever 66. This lever pivots about a pivot pin 68 so that the other end engages the bar 56. Similarly, a second lever 70 also engages the bar and pivots about a pivot pin 72 so that its other end engages the plunger 64 on the left hand side of the box. This second plunger is toggled as at 74 to this same end of this second lever and the latter is connected to the first lever by a connecting rod or extension 76 so that movement of the bar also always moves both plungers and vice versa.

The plungers 64 are each provided with an inwardly extending cam 78 of a width substantially equal to the open ended notches 52 and located closer to the inward ends of the plungers, i.e., the ends of the plungers nearest the levers 66 and 70, so as to be received therein at a time when the cams 60 on the tynes 58 are not received in the rectangular apertures 50. Thus, it can be appreciated that the notches 52 and apertures 50 both provide a means for receiving their respective cams 78 and 60 so that the top plate can move toward the bottom plate.

Movement of the top plate towards the bottom plate is effected by resilient means in the form of a pair of coil springs 80 positioned by two guide pins 82 located on the bottom plate and which normally urge the top plate towards the bottom plate. On the other hand, the action of the cams on the plungers and on the tynes during the travel of the tynes and plungers will force terminals of the top plate away from the bottom plate against the action of the resilient means. It is to be understood that while a leaf spring 84 is shown engaging the guide pins 82 as a means for adjusting the tension of the springs 80, adjusting nuts threaded on the guide pins will be equally practical.

With reference to FIG. 3, it can be seen that the device 16 to be connected in the connector is, for example, a bubble memory cassette, which has an opening 86 on the front end thereof, i.e., the side to be inserted into the connector, and is provided centrally thereof with a printed circuit board 88 or similar plate having terminals 90 located on each side of the board which terminals correspond to an equal number of and correspondingly positioned the terminals 40 and 54 on the top and bottom plates so that, when positioned in the connector, the bubble memory device is electrically connected to the ribbon cable and to other electronic devices. It is to be noted that the inside of the box is also provided with a guide means comprising a pair of channel members 92 spaced apart substantially the width of the spacing between the tynes to guide entrance of the cassette so that, upon insertion of the cassette in the guide means, the cassette will engage the ends of the tynes.

In the operation of this invention, when the plungers are in its innermost position, i.e., when the connector is empty, the two levers 66 and 70 are canted (as shown in FIG. 3) so that the bar and the tynes are in their forwardmost position. In this position, the plunger cams 78 are received in the notches 52 in the upper plate. When the cassette is inserted in the box through front wall aperture 20 and into the guide means 92, the cassette edges 94 (or front side wall) engage the ends of the tynes 58 and continued inward movement of the cassette forces the top and bottom plates apart by the action of the aforementioned cams. The two plates will remain separated until the tyne cams 60 are received in apertures 50, and the plunger cams 78 are free of the top plate, being forward of its front edge, at which time the resilient means 80 again urges the top plate down towards the bottom plate but this time the terminals 90 of the cassette is engaged by the connector terminals.

At this time, i.e., when the connector is loaded, the two plungers 64 are in their forwardmost position and in the embodiment illustrated the two levers are now aligned as shown in FIG. 5. For a convenient reference, contact means 96 one of which is located on the right hand plunger 64 engages a stationary contact 98 all as part of the circuit 30 to connect the lamp 28 to a power supply 100 to light the latter indicating that the cassette is in its final or contact position in engagement with the terminals on the top and bottom plates.

In this contact or connector loaded position, the aligned levers provide a means for disengaging the cassette from the connector by simply manually pushing in on the knob 26 causing plunger 64 to engage the righthanded lever 66 which in turn pivots and forces the bar forward whereby the tynes urge the cassette forward and out of the connector. It is to be noted that again this time the cams 60 and 78 first separate the two plates so that the cassette is removed without any sliding between the terminals and at the same time the connection between the power source and the lamp is disconnected indicating that the cassette is not in its electrical contact position. Note there is no relationship between the contact terminal contact force of the resilient means 80 and the force necessary to insert and remove the cassette. The first force, the terminal contact force, operates at 90° to the latter force.

It can be appreciated that it is within the scope of this invention, depending upon the choice of the user of the connector, to locate the cams relative to each other and relative to the apertures and notches so that a slight sliding or wiping force between the terminals on insertion of the cassette may be provided if the user thinks that a wiping action on the terminals is necessary for good contact thus ensuring a good electrical connection between the terminals. This is, of course, a matter of discretion. While the foregoing disclosure relates to a cassette, any suitable device such as a printed circuit board per se may be used in this connector. The choice of the width and thickness of the connector will depend on the device to be received and one can select the thickness and distance between the ends of the tynes as well as the thickness and distance between the guide means, as desired.

Thus, from the foregoing, it can be seen that there has been provided a connector in which the user has two choices without any major modifications of the original structure. The first choice is to have a zero insertion/-zero retraction force connector with no wiping action with selectable control of the amount of force imposed on the contacts to make a good electrical connection; it being understood that at the present time a force of about 70–125 grams per contact is feasible for a good connection. Secondly, by simply adjusting the location of the cams on the tynes and plungers, or the location of the aperture 50 and notches 52, as the case may be, a slight wiping action can be provided.

Figure 2:
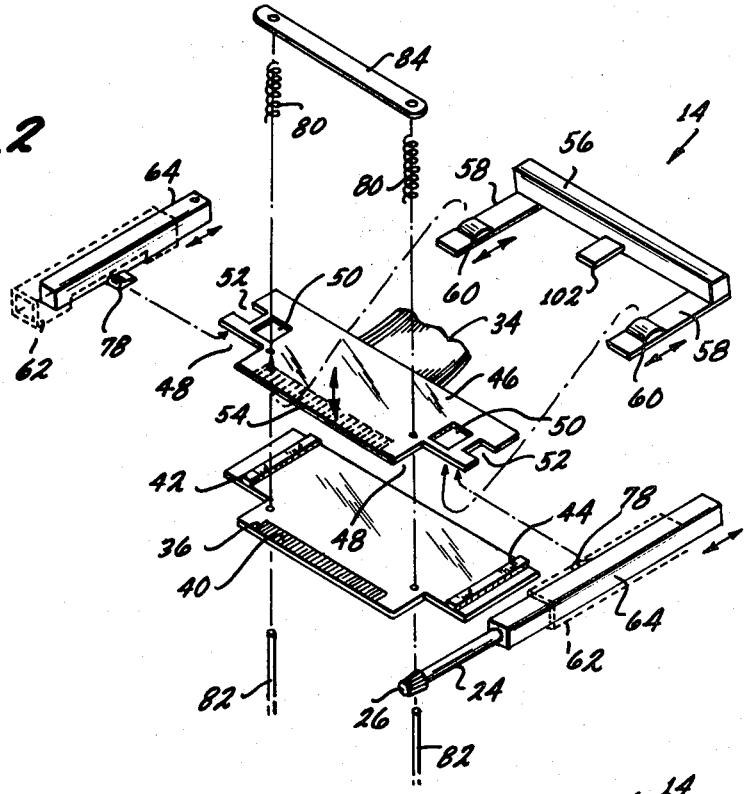
FIG. 2 is an exploded view, also in perspective, illustrating the actuating mechanism embodied in the connector as shown in FIG. 1.
Figure 7:
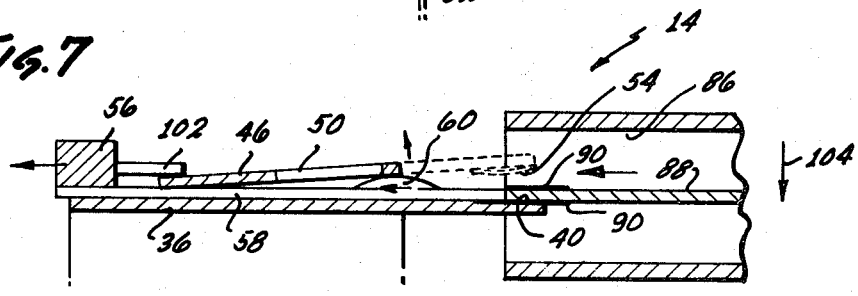
FIG. 7 is a side view showing the action of the connector as the cassette is being inserted.

With particular reference to FIGS. 2 and 7, the tab 102 fixed to the bar 56 and shown holding the upper plate canted in FIG. 7 may be eliminated since the positioning of the spring means 80 and 84 will suffice to properly position the upper plate 46 depending on the desires of the user. Too, the lower portion of the guides 92 may be provided with a cushioning material or they may be simply vertically long enough to allow a loose fit relative to the cassette to permit the cassette to move downwardly as shown by arrow 104 if desired.

Obviously, too, while a tension adjustor such as the spring 84 on the coil spring guide means 82 has been shown and described, once the user has selected the tension of the selected resilient means, tension adjusting means is no longer necessary. He need only duplicate such the force of the resilient means in his mass production process. Finally, while box 10 is shown, any suitable support for the actuating mechanism will suffice; again that is at the discretion of the user.

What is claimed is:

1. A zero insertion/retraction connector for connecting terminal conductors of an electronic device to other electronic devices comprising, means for receiving the device, actuable means in said receiving means including:

means supporting a first set of electrical conductor terminals, means supporting a second set of electrical conductor terminals, resilient means for urging said second support means towards said first support means when said device is absent from said receiving means, means for displacing said second support means against the urging of said resilient means as said device is being inserted in said receiving means to permit the terminals of said device to move between the terminals of said first and second support means but out of contact therewith, and means enabling said resilient means to again urge said second support means toward said first support means to effect the mating of said terminals on said device with said terminals on said support means.

2. The connector as claimed in claim 1 wherein said actuable means includes fork means the tynes of which are engaged by said inserted device for slidable movement relative to said first and second support means.

3. The connector as claimed in claim 2 wherein said actuable means includes camming means which engages said first and second supporting means to displace said second supporting means relative to said first supporting means.

4. The connector as claimed in claim 3 wherein said camming means is located on said fork.

5. The connector as claimed in claim 4 further including plunger means movable in response to movement of said fork means and including camming means on said plunger means.

6. The connector as claimed in claim 5 wherein said actuable means further includes pivotal means operatively connecting said fork with said plunger means and arranged to displace the fork means and the plunger means in opposite directions from each other.

7. The connector as claimed in claim 6 further including lamp means for indicating when the terminals of said inserted device is in an electrical contact with the terminals of said connector.

8. The connector as claimed in claim 7 further including guide means for said device within said receiving means.

* * * * *